US005545487A

United States Patent [19]

Ishijima et al.

[11] Patent Number: 5,545,487

[45] Date of Patent: Aug. 13, 1996

[54] WEAR-RESISTANT SINTERED ALUMINUM ALLOY AND METHOD FOR PRODUCING THE SAME

[75] Inventors: Zenzo Ishijima; Jun-ichi Ichikawa; Shuji Sasaki; Hideo Shikata, all of Matsudo; Hideo Urata, Wako; Shoji Kawase, Wako; Jun-ichi Ueda, Wako, all of Japan

[73] Assignees: Hitachi Powdered Metals Co., Ltd., Chiba; Honda Giken Kogyo Kabushiki Kaisha, Tokyo, both of Japan

[21] Appl. No.: 385,988

[22] Filed: Feb. 9, 1995

[30] Foreign Application Priority Data

Feb. 12, 1994 [JP] Japan ..... 6-037606
Dec. 21, 1994 [JP] Japan ..... 6-335712

[51] Int. Cl.[6] ..... B22F 7/00

[52] U.S. Cl. ..... 428/548; 428/545; 428/546; 428/551; 428/552

[58] Field of Search ..... 428/545, 546, 428/551, 552, 548; 420/528, 529, 553, 534, 535, 543, 548

[56] References Cited

U.S. PATENT DOCUMENTS

| | | | |
|---|---|---|---|
| 4,055,417 | 10/1977 | Komiyama et al. | 420/532 |
| 4,177,069 | 12/1979 | Kobayashi et al. | 75/213 |
| 4,537,167 | 8/1985 | Eudier et al. | 123/193 |
| 4,847,048 | 7/1989 | Nishi et al. | 420/547 |
| 4,865,808 | 9/1989 | Ichikawa et al. | 428/548 |
| 4,938,810 | 7/1990 | Kiyota et al. | 148/437 |
| 5,344,507 | 9/1994 | Masumoto et al. | 148/437 |
| 5,366,691 | 11/1994 | Takeda et al. | 420/548 |
| 5,415,710 | 5/1995 | Shiina et al. | 148/439 |

FOREIGN PATENT DOCUMENTS

| | | |
|---|---|---|
| 59-37339 | 9/1984 | Japan . |
| 62-10237 | 1/1987 | Japan . |
| 5-156399 | 6/1993 | Japan . |
| 647685 | 6/1994 | Japan . |

*Primary Examiner*—Charles T. Jordan
*Assistant Examiner*—John N. Greaves
*Attorney, Agent, or Firm*—Birch, Stewart, Kolasch & Birch, LLP

[57] ABSTRACT

The Al-Si sintered alloy having good mechanical strength and elongation and is especially excellent in wear resistance, and a method for producing the same. The sintered alloy consists of 2.4–23.5% Si, 2–5% Cu, 0.2–1.5% Mg, 0.01–1% of transition metals and the balance of aluminum and unavoidable impurities, and has a dapple grain structure of an Al-solid solution phase and an Al-Si alloy phase containing dispersed pro-eutectic Si crystals having a maximum diameter of 5–60 μm either in the whole body or in the surface contact portion, and the area ratio of the Al-solid solution phase in the grain structure is in the range of 20–80%.

8 Claims, 2 Drawing Sheets

WEAR-RESISTANT SINTERED ALUMINUM ALLOY AND METHOD FOR PRODUCING THE SAME

BACKGROUND OF THE INVENTION (1) Field of the Invention

This invention relates to a sintered aluminum-base alloy and method for producing the same. The sintered aluminum alloy of the present invention is characterized in strength, small weight and excellent wear resistance. Accordingly, it is suitable for use in producing parts of machinery such as gearwheels, pulleys, compressor vanes, connecting rods, and pistons, in which the excellence in the above properties are required.

(2) Description of Prior Art

In view of economy in energy consumption and improvement in mechanical efficiency, demands for lightweight machine parts are increased. Because it is possible for a sintered aluminum alloy that the content of fine crystals of pro-eutectic Si can be increased as compared with cast alloys, the sintered aluminum alloy is expected as a material having excellent specific strength and wear resistance.

As a conventional method for producing sintered aluminum alloy, Japanese Laid-open Publication No. 53-128512 discloses a method of mixing some members selected from the group consisting of Al-10/35% Si powder, Cu powder, Mg powder, Al-Cu powder, Cu-Mg powder, Al-Cu-Mg powder, Cu-Mg-Si powder, and Al-Cu-Mg-Si powder, and if necessary, further adding Al powder to obtain a composition consisting of, in weight-basis, 0.2–4% Cu, 0.2–2% Mg, 10–35% Si, and the balance of Al, then compacting the powder mixture and sintering the obtained green compact to produce a desired product. This method is the so-called mixing method in which several powders are mixed together. Because soft metal powder can be mixed in the method of this kind, the compacting process can be improved. Furthermore, because fairly strong sintered products can be produced only by the conventional compacting and sintering processes, this mixing method is employed for the production of various machine parts of which special strength is not required.

Besides the above-described method, a sintered product of rapidly solidified aluminum alloy is disclosed in Japanese Laid-open Patent Publication No. 62-10237, in which pro-eutectic Si crystals are uniformly dispersed in an Al-Si alloy matrix. This alloy has a composition, in terms of weight, of 10–30% Si, 1–15% in total of one or more members of Ni, Fe and Mn, and if necessary, 0.5–5% Cu and 0.2–3% Mg, and the balance of Al and unavoidable impurities, and the alloy product is prepared through compacting and hot press forging processes. According to this alloying method, highly strong products can be obtained as compared with those prepared by the mixing method. However, because the powder which is prepared by rapid solidification is hard, the near-net shaping using a metal mold is difficultly carried out, powder particles are coated with hard oxide films and any liquid phase is not produced during the sintering. Therefore, the sufficient combining of powder particles cannot be attained only by sintering and repeated pressing operations such as extrusion from billet forms and forging are required. Accordingly, there remain some problems in this method in view of workability and production cost.

In order to solve the above problems, another method is proposed in Japanese Laid-open Patent Publication No. 5-156399 as a combination of mixing method and alloying method. The alloy product is prepared by mixing a certain amount of pure Al powder with rapidly solidified Al-Si alloy powder and the powder mixture is subjected to hot press forging. Its composition in terms of weight is 12–30% Si, 1–10% of one or both of Fe and Ni, and if necessary, one or both of 1–5% Cu and 0.3–2% of Mg, and the balance of Al and unavoidable impurities. In the grain structure of this alloy, 5–20 vol.% of the grains of Al-solid solution which are deformed in hot forging process, are dispersed in an eutectic Al-Si alloy matrix containing dispersion of fine pro-eutectic Si crystals. In this alloy, the Al-solid solution acts as an adhesive to improve the mutual close adhesion among hard particle boundaries. As a result, the wear resistance and strength are improved.

Meanwhile, with the tendency to employ aluminum alloy parts for various high-performance machinery, those which have relatively high strength and is especially high in wear resistance, are demanded in the industry.

Although the above-described conventional alloys have their own advantages, the reason why the ductility of alloys made by mixing method is not so high enough, is considered that, when liquid phase sintering is carried out in the state in which pro-eutectic Si crystals do not become coarse, the Cu which is added to improve the strength of alloy matrix cannot be dispersed sufficiently in the matrix and it precipitates in the form of intermetallic compound in the vicinity of grain boundaries with reducing the ductility.

Furthermore, in the conventional Al-Si alloy, fine pro-eutectic Si crystals are uniformly dispersed, so that both the strength and wear resistance are high. However, in view of the state of wearing, the hard pro-eutectic Si crystals which are released from the surface of alloy matrix in sliding contact may act as an abrasive. Therefore, there is room for betterment in the conventional aluminum alloy.

BRIEF SUMMARY OF THE INVENTION

In view of the above-mentioned circumstances, the object of the present invention is to propose an Al-Si sintered alloy which is relatively high in strength and excellent in wear resistance by designing the novel grain structure of an alloy composition.

In order to attain the above object, a sintered alloy composition of the present invention was accomplished on the bases of the following consideration with employing the mixing method.

(a) It is possible to prevent hard Si crystals from being released off to improve the wear resistance by forming a dapple grain structure of Al-Si alloy phase which contains a certain amount of dispersed pro-eutectic Si crystals and Al-solid solution phase.

(b) There is observed an optimum value in the area ratios of the grain structure in order to improve the strength and the wear resistance.

(c) There is an optimum size in the maximum diameter of pro-eutectic Si crystals also in order to improve the strength and the wear resistance.

(d) It is possible to improve the ductility by adding at least one member of the group consisting of Ti, V, Cr, Mn, Fe, Co, Ni, Zr, and Nb (hereinafter referred to as "transition metals") so as to reduce Cu alloy phase in grain boundaries. As a measure to add these transition metals, the powder of Cu-transition metal alloy is preferable.

The alloy according to the present invention has a composition, in terms of weight, of 2.4–23.5% Si, 2–5% Cu, 0.2–1.5% Mg, 0.01–1% of transition metals, and the balance of aluminum and unavoidable impurities. The alloy has a grain structure of Al solid solution phase and Al-Si alloy phase containing dispersed pro-eutectic Si crystals having a maximum diameter of 5–60 μm, and the area ratio of the Al solid solution phase is 20–80 percent in the cross-section of the grain structure.

In another aspect of the present invention, the pro-eutectic Si crystals having a maximum diameter of 5–60 μm is not always dispersed in all body of the Al-Si alloy phase. In other words, large crystals of pro-eutectic Si must be dispersed only in the vicinity of the surface of sintered alloy which surface will be brought into frictional contact with other material in practical uses.

That is, the maximum diameter of the pro-eutectic Si crystals dispersed in the Al-Si alloy phase in the vicinity of the external surface or at least the sliding contact surface is 5–60 μm, and the diameter of the pro-eutectic Si crystals in the remaining part may be less than 5 μm.

The thickness of the portion of Al-Si alloy phase containing dispersed pro-eutectic Si crystals having a maximum diameter of 5–60 μm, is in the range of 0.05 to 1 mm in depth as measured from the surface of the sintered alloy body.

In the method for preparing the above-mentioned sintered alloy according to the present invention, 20–80 parts by weight of Al-Si alloy powder containing 13 to 30 wt. % of Si and 80-20 parts by weight of Al powder are mixed together. Then, a Cu-transition metal alloy powder containing 0.2–30 wt. % of one or more transition metals, and Mg powder or Al-Mg alloy powder containing 35 wt. % or more of Mg are mixed to the above obtained mixture of Al powder and Al-Si alloy powder, thereby obtaining a powder mixture having the composition in terms of weight of 2.4–23.5% Si, 2–5% Cu, 0.2–1.5% Mg, 0.01–1% of transition metals and the balance of aluminum and unavoidable impurities. The powder mixture is then subjected to compacting to form a green compact and it is then sintered. In the sintering, the maximum diameter of the pro-eutectic Si crystals are grown up to 5–60 μm.

In another method of the present invention, the above sintering is so carried out that the diameter of the pro-eutectic Si crystals is grown up to 5 μm or less in the first stage and the surface portion of sintered alloy body or only a partial surface which must be brought into sliding contact is then heated to grow up the pro-eutectic Si crystals to 5–60 μm in maximum diameter.

The heating of the alloy of this kind is carried out by means of, for example, high-frequency heating, plasma heating or laser beam heating.

This sintered alloy material can be used as it stands in the form of sintered body. If necessary, the sintered alloy articles may further be subjected to the working with plastic deformation such as extrusion, forging or rolling at ordinary or elevated temperatures, or to the conventional treatment for alloys such as solution heat treatment and aging treatment.

BRIEF DESCRIPTION OF DRAWINGS

The above and further objects and novel features and advantages of the present invention will become more apparent from the following description taken in connection with the accompanying drawings in which.

DETAILED DESCRIPTION OF THE INVENTION

Figure 1:
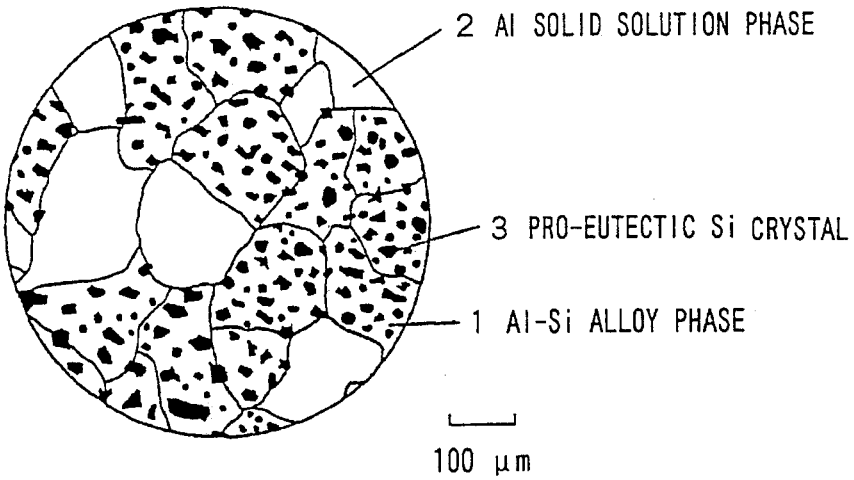
FIG. 1 is a schematic illustration in microscopic view showing the cross-section of the grain structure of a first embodiment of the sintered alloy of the present invention.

In the following, several features in the present invention such as the quantities of components of the composition, the structure of alloy, the selection of powder material and so forth are described.

(1) Dapple Grain Structure

The grain structure of the sintered alloy consists of the grains of Al solid solution phase and Al-Si alloy phase. In the latter Al-Si alloy phase, pro-eutectic Si crystals are dispersed.

The Al-Si alloy phase containing the dispersion of pro-eutectic Si crystals is a solid solution of diffused Mg, Cu and transition metals. The pro-eutectic Si crystals are dispersed in the relatively hard matrix of this phase and they contribute to the improvement in strength and wear resistance of the alloy material.

In the Al-solid solution phase, Si, Mg, Cu and transition metals are diffused as a solid solution in Al which was added in the form of pure Al powder. This phase constitutes one of the alloy phases in the dapple grain structure and it is relatively soft. When the sintered alloy material suffers from wear in the initial stage, minute oil cavities are formed among the grains of this phase and Al-Si alloy phase, which contribute to the lubricating property and conformability with contact material in sliding contact. Furthermore, because the alloy is susceptible to plastic deformation, when the hard pro-eutectic Si crystals in a sliding surface are exposed or released off as abraded powder, they are buried in the alloy matrix and it prevents the Si crystals from acting as wear particles.

In the above-mentioned combination of two phases of Al solid solution phase and Al-Si alloy phase containing the dispersion of pro-eutectic Si crystals, when the area ratio of Al-Si alloy phase is less than 20% in the cross-section of the alloy body, the wear resistance is very low because the quantity of pro-eutectic Si crystals is too small. On the other hand, when the area ratio of Al-Si alloy phase is more than 80%, wear resistance is not high either because the quantity of Al solid solution is too small in order to bury the Si crystals which are released in frictional contact.

Accordingly, the area ratios of both phases in the cross-section of alloy must be in the range of 20–80:80-20, in which the two phases form a grain structure and, by the mutual action of the grains of both phases, the strength and wear resistance can be improved.

(2) Si

The component of Si in the aluminum alloy is effective in reducing the thermal expansion coefficient and improving the wear resistance.

The quantity of Si in the whole composition is selected from the range that the mixture of Al-solid solution phase and Al-Si alloy phase containing dispersed pro-eutectic Si crystals, exhibits a dapple grain structure. For this purpose, the range of 2.4–23.5% by weight is suitable.

If the quantity of Si is too small, the quantity of pro-eutectic Si crystals in the Al-Si alloy phase or the Al-Si alloy phase itself is too small, in which cases the wear resistance is not satisfactory because of the lack of the pro-eutectic Si crystals which contributes to the wear resistance. On the other hand, a excessively large quantity of Si means that the quantity of Si in the Al-Si alloy phase is too large or the quantity of Al-Si alloy phase itself is too large, in which the toughness is low and the quantity of Al solid solution which buries the pro-eutectic Si crystals released in sliding contact, is too small. Therefore, the wear amount is increased due to the loss of the effect of dapple grain structure.

The component of Si is added in the form of Al-Si alloy powder. It is necessary that the content of Si is 13% by weight or more in order to precipitate the pro-eutectic Si crystals. On the other hand, if the content of Si is more than 30% by weight, the temperature of melted material in the powder making must be made high. Therefore, the content of Si in the Al-Si alloy is preferably in the range of 13 to 30% by weight.

(3) Mg

Mg becomes a liquid phase during the sintering and therefore, it exists in the matrix in the form of solid solution, which is effective in the acceleration of sintering, in the strengthening of matrix with $Mg_2Si$ that is precipitated in aging treatment, and in the improvement in wear resistance.

If the quantity of Mg is less than 0.2% by weight in the whole composition, the above effect of the addition of Mg cannot be expected. On the other hand, even if the quantity of Mg is increased to a value more than 1.5% by weight, the effect of addition is not increased more than a certain level. Therefore, the quantity of addition of Mg is desirably in the range of 0.2 to 1.5% by weight.

As a measure to add the Mg component, Al-Mg alloy powder containing 35 wt. % or more of Mg or Mg powder itself is used. The reason for the use of the Al-Mg alloy powder is that the melting point of the binary Al-Mg alloy containing 33–70 wt. % of Mg is as low as about 460° C. In the case that pure Mg powder is added, the Mg concentration is reduced by the solid phase diffusion with Al matrix in the process of sintering to form a liquid phase of Mg. Meanwhile, when the Al-Mg alloy powder containing 33 wt. % or less of Mg is used, the Mg concentration is lowered by the diffusion into Al matrix as described above, which results in the rise of melting point and the liquid phase cannot be utilized effectively. It is, therefore, preferable that the concentration of Mg is 35 wt. % or higher.

(4) Cu and transition metals

The component Cu is effective in strengthening the Al alloy matrix and its effect can be improved by the aging treatment. If Cu content is less than 2 wt. % in the whole composition, any desirable improvement in strength cannot be expected. If the content of Cu exceeds 5 wt. %, the toughness is lowered because much intermetallic compound mainly containing Cu is formed in the vicinity of grain boundaries.

In the case that Cu is added in the form of Cu powder, when heating is done, the Cu exists as a solid solution in the alloy matrix, therefore, the pro-eutectic Si crystals become coarse like those in ingot materials. On the other hand, when the heating temperature is low and heating time is short, the strength is lowered because intermetallic compounds of Cu remain in the grain boundaries in the alloy matrix. In the case that suitable quantities of transition metals such as Ti, V, Cr, Mn, Fe, Co, Ni, Zr, and Nb are added to coexist, the intermetallic compounds in the grain boundaries can be extinguished by solution heat treatment and aging treatment. This is considered that, when the super saturated Cu solid solution in the matrix is precipitated, the existing transition metals combine with the Cu and Si to reduce the quantities of Cu and Si in the alloy matrix and the Cu of the intermetallic compound in grain boundaries is diffused into the matrix.

In the above-described Cu content, if the quantity of the transition metal in the whole composition is less than 0.01 wt. %, none of its effect is produced. On the other hand, if the quantity of the transition metal exceeds 1 wt. %, the intermetallic compound mainly containing the transition metal is produced which results in the lowering of toughness. Therefore, the quantity of transition metals must be in the range of 0.01 to 1 wt. %.

The transition metal is preferably added in the form of powder of Cu-transition metal alloy because it is hardly diffused in the form of a single substance. The quantity of transition metal in the alloy powder must be more than 0.2 wt. % with considering the necessary quantities of Cu and transition metal in the whole composition. However, if the quantity of transition metal is more than 30 wt. %, the melting point of the alloy becomes too high and any liquid phase is not produced even when the melting point is lowered by solid phase diffusion in the sintering. Therefore, the quantity of transition metal added in the Cu-transition metal alloy is preferably in the range of 0.2 to 10 wt. %.

(5) The diameter of pro-eutectic Si crystals in Al-Si alloy phase

The cross-sectional shape of each pro-eutectic Si crystal is roughly circular and the lengths of its longer diameter and perpendicular shorter diameter is about the same in the case of small pro-eutectic Si crystals. A large crystal is considered to be an agglomerate of small crystals or a grown crystal and there are various kinds of shapes such as a long one, curved one, angular one and irregular one. The term "maximum diameter" herein referred to means the largest length between both opposed end portions of a pro-eutectic Si crystal in an irregular shape obtained in the microscopic observation of the cross section of a largest alloy crystal of an area of about 5 $mm^2$.

If the diameter of a pro-eutectic Si crystal is large, the protruded tip end of the hard Si crystal scratches the surface of contact material to cause the wearing. Meanwhile, if the quantity or the diameter of the pro-eutectic Si crystals is small, the Si crystals are released off from the surface of alloy matrix in sliding contact. Because the released Si crystals act as an abrasive powder, wearing is caused to occur. Accordingly, in view of the wear resistance, the maximum diameter of pro-eutectic Si crystals must be properly determined and the value is desirably in the range of 5 to 60 μm.

In view of the strength of sintered alloy products, if the diameter of pro-eutectic Si crystals is large, the strength and ductility are small. Meanwhile, with a smaller diameter of Si crystals, a larger strength can be attained. Therefore, the diameter of 5 μm or less is preferable in view of this points.

Therefore, according to the present invention, the maximum diameter of pro-eutectic Si crystals is 5 to 60 μm in view of the wear resistance. In the second aspect of the present invention, the maximum diameter of pro-eutectic Si crystals in the surface portion or at least the surface portion which is brought into sliding contact in practical uses, is made 5 to 60 μm in view of the wear resistance, and at the same time, the maximum diameter of pro-eutectic Si crystals in the inner part of sintered alloy material is made 5 μm or less in view of the strength. By employing this structure, both the wear resistance and strength can be made satisfactory.

The thickness of the Al-Si alloy phase containing the dispersed pro-eutectic Si crystals of 5 to 60 μm in maximum diameter in the surface portion of the sintered alloy, is preferably in the range of 0.05 mm to 1 mm. This depends upon the frictional conditions in use, however, if the thickness of the surface portion containing larger Si crystals is smaller than 0.05 mm, the pro-eutectic Si crystals are liable to be released off and good wear resistance cannot be obtained. On the other hand, even if the thickness of the surface portion is increased more than 1 mm, no additional effect in wear resistance cannot be obtained but the thickness of inner portion which contributes to the strength is reduced. It is, therefore, desirable that the thickness of the layer containing the dispersed pro-eutectic Si crystals of 5–60 μm is in the range of 0.05 to 1 mm.

(7) Sintering temperature and Sintering atmosphere

It is possible to regulate the size of the pro-eutectic Si crystals by the combination of temperature and time length of sintering or solution heat treatment. However, if the sintering temperature is higher than 560° C., the pro-eutectic Si crystals are liable to become coarse and sintered articles are deformed. On the other hand, when the temperature of sintering is lower than 500° C., a liquid phase is scarcely generated which necessitates very long sintering time.

The atmosphere for the sintering is vacuum or low dew point inert gases such as nitrogen and argon.

(8) Solution heat treatment and aging treatment

In order to improve the strength of alloy matrix, the precipitation hardening of the compounds of Si, Cu, Mg and transition metals is caused to occur. At the same time, because the intermetallic compounds mainly containing Cu must be extinguished by making them to exist as a solid solution in the alloy matrix, solution heat treatment and aging treatment are necessary.

Incidentally, if rapid cooling is done without slow cooling in the sintering process, the reduction of production cost can be attained because the sintering and solution heat treatment can be carried out in succession.

(9) Density of sintered alloy

The density of the sintered alloy in the present invention is not limited because sintered alloy products having many pores which are obtained through ordinary processes of compacting and sintering, or those produced with receiving additional process of solution heat treatment or aging treatment, can be used for the purposes requiring high sliding characteristics, by increasing the capacity of a lubricating oil.

However, because strength and wear resistance can be improved by raising a density ratio, it is desirable to subject sintered alloy products to other appropriate processes such as rolling, forging or extruding at elevated temperatures.

For example, in the case that a sintered alloy product of 90% in density ratio is 220 MPa in tensile strength and 4 mm in wear amount, if the alloy product is processed by hot press forging to raise the density ratio up to 100%, the tensile strength can be improved to 380 MPa and the wear amount is reduced to a value as low as 0.01 mm.

The dapple grain structure of the sintered alloy of the present invention will be described with reference to the accompanying drawings.

FIG. 1 schematically illustrates the cross-section of the microscopic dapple grain structure of the sintered alloy in a first embodiment of the present invention.

The grain containing black spots is an Al-Si alloy phase 1. The white grain represents an Al-solid solution phase 2. The black spots 3 in the Al-Si alloy phase 1 are pro-eutectic Si crystals. The Al-Si alloy phase 1 and the Al-solid solution phase 2 are distributed in mottled side by side relationship.

The wear resistance is highest when the area ratios of the two kinds of phases in the cross-section of the sintered alloy are in the range of 20–80 to 80-20. The wear resistance is markedly lowered if the ratio of the Al-Si alloy phase 1 containing dispersed pro-eutectic Si crystals is either lower than 20% or higher than 80%.

Figure 2:
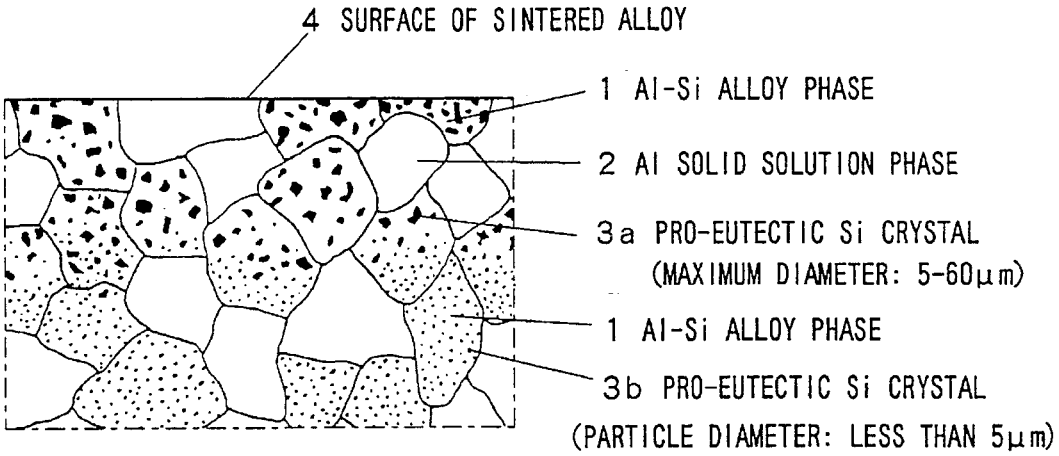
FIG. 2 is also a schematic illustration showing the cross-section of the grain structure of a second embodiment of the sintered alloy of the present invention.

FIG. 2 also schematically illustrates the cross-section of the dapple grain structure of the sintered alloy in a second embodiment of the present invention.

The grain containing black spots is an Al-Si alloy phase 1. The white grain represents an Al-solid solution phase 2. The larger black spots *3a* in the Al-Si alloy phase 1 are pro-eutectic Si crystals having a maximum diameter of 5 to 60 μm and they exist in the vicinity of the surface 4 of the sintered alloy. The smaller black spots *3b* in the Al-Si alloy phase 1 are pro-eutectic Si crystals having a diameter of 5 μm or less in the inner part of the sintered alloy.

The wear resistance of the sintered alloy can be improved by the provision of the larger Si crystals *3a*, meanwhile the strength of the sintered alloy is improved by the provision of the smaller Si crystals *3b*. The structure of the pro-eutectic Si crystals *3a* and *3b* can be formed by sintering the whole body of the green compact of alloy powders within a certain extent that the average diameter of Si crystals is limited to 5 μm or less in the first step. In the next step, the surface portion of the sintered alloy body is partially heated by means of, for example, high frequency heating, plasma heating or laser beam heating so as to grow up the Si crystals only in the surface portion to 5 to 60 μm in maximum diameter. The surface portion to be heated partially can be limited to the area which is brought into sliding contact with other contact material in practical uses.

EXAMPLE 1

Al-Si alloy powders, pure Al powder, Cu-4% Ni alloy powder and Al-50% Mg alloy powder were used for preparing samples of powder mixture. In the powder mixtures, the contents of Cu-4% Ni alloy powder was made 4.17 wt. % and Al-50% Mg alloy powder, 1 wt. % in all samples. The kinds and quantities of Al-Si alloy powders and the quantities of pure Al powder were changed to obtain powder mixtures, Sample Nos. 1–18. These powder mixtures were compacted into green compacts of a certain shape.

The Si contents in the above Al-Si alloy powders were 5 kinds of 15%, 17%, 20%, 25% and 30%.

The green compacts were dewaxed at 400° C. and sintered at 540° C. for 60 minutes. After that, the density ratios of them were made to 100% by hot press forging, and they were subjected to solution heat treatment at 490° C. and aging treatment at 240° C.

In connection with each sample, the tensile strength and the wear amount by pin-on-disk wear test were measured. In the pin-on-disk wear test, each sample to be tested was made in the form of a pin and a disk made of heat treated-S48C steel (carbon steel for machine construction) was used as a contact material. The sliding speed was 5 m/sec under mineral oil lubrication and the contact pressure was 49 MPa.

In Table 1, the kinds of Al-Si alloys, Si contents in whole compositions, area ratios of soft Al solid solution phases in grain structures, and wear amounts are shown. The weight ratios in the whole composition were 4% Cu, 0.5% Mg and 0.17% Ni.

Figure 3:
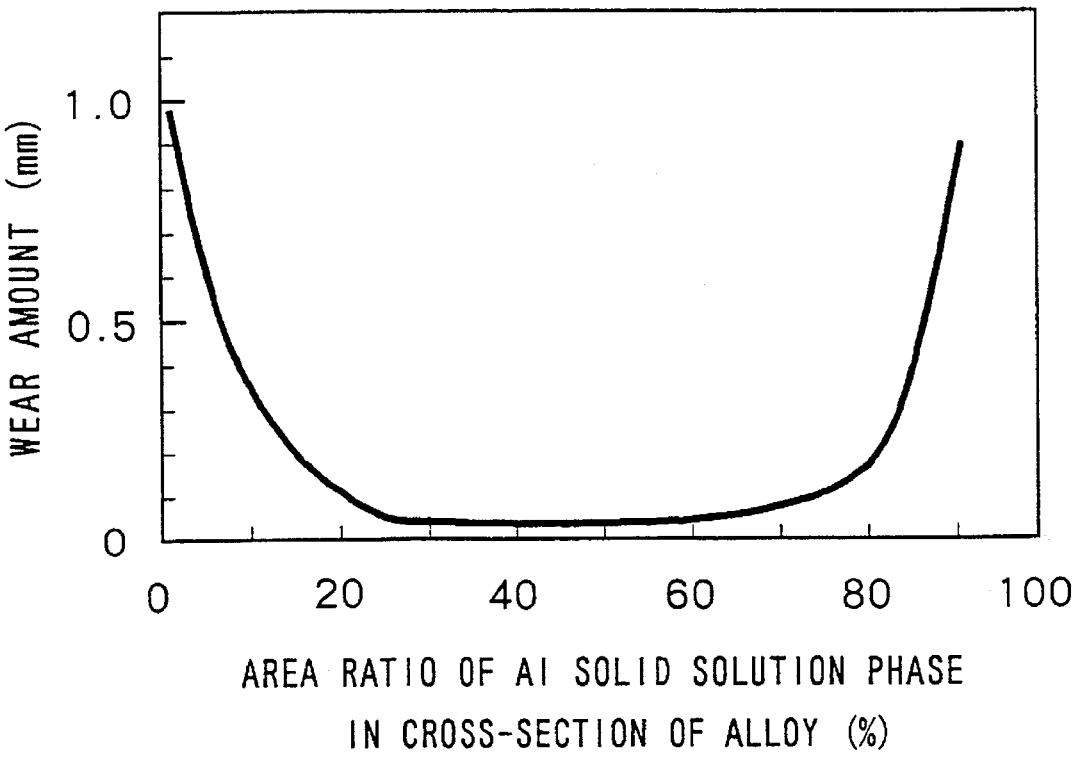
FIG. 3 is a graphic chart showing the relationship between the wear amount and the area ratios of Al-solid solution phase in the cross sections of grain structure of the alloy.

The relationship between the area ratios of Al solid solution phases in the grain structures of Sample Nos. 1 to 18 and their wear amounts are shown in FIG. 3.

As will be understood from FIG. 3, the wear amounts are small if the Si contents in Al-Si alloy powders are within a certain range and the area ratios of Al solid solution phases in the cross-section of alloys are in the range of 20–80%, meanwhile the wear amounts are markedly increased if the area ratio is either less than 20% or more than 80%.

TABLE 1

| Sample No. | Item: Si Content in Al—Si Alloy Powder (wt. %) | Si Content in Whole Composition (wt. %) | Area Ratio of Al-Solid Solution (%) | Wear Amount (mm) |
|---|---|---|---|---|
| 1 | 30 | 5 | 82 | 0.3 |
| 2 | 25 | 5 | 79 | 0.2 |
| 3 | 20 | 5 | 74 | 0.1 |
| 4 | 17 | 5 | 69 | 0.05 |
| 5 | 30 | 10 | 65 | 0.04 |
| 6 | 25 | 10 | 58 | 0.03 |
| 7 | 20 | 10 | 47 | 0.03 |
| 8 | 17 | 10 | 38 | 0.03 |
| 9 | 30 | 15 | 47 | 0.03 |
| 10 | 25 | 15 | 37 | 0.03 |
| 11 | 20 | 15 | 21 | 0.05 |
| 12 | 17 | 15 | 7 | 1.0 |
| 13 | 15 | 15 | 0 | Seizing |
| 14 | 30 | 20 | 30 | 0.03 |
| 15 | 25 | 20 | 16 | 0.2 |
| 16 | 20 | 20 | 0 | Seizing |
| 17 | 30 | 25 | 12 | 0.4 |
| 18 | 25 | 25 | 0 | Seizing |

EXAMPLE 2

Al-20% Si alloy powder (75 parts by weight) was mixed with 25 parts by weight of pure Al powder. To this mixture were added Cu-4% Ni alloy powder and Al-50% Mg alloy powder to obtain a powder composition in terms of weight of 15% Si, 4% Cu, 0.5% Mg, 0.17% Ni and the balance of Al. This powder mixture was compacted to form several pieces of green compacts and they were dewaxed at 400° C. They were then sintered at a temperature of 540° C. for 5 to 180 minutes. In the like manner as the foregoing Example 1, each sintered body was subjected to hot press forging, solution heat treatment and aging treatment so as to obtain sample Nos. 19 to 23.

In the grain structure of a sample in which the sintering time was short, the diameter of pro-eutectic Si crystals was small. Meanwhile, in the sample which was treated with a longer sintering time, the particle diameter of pro-eutectic Si was large.

The maximum diameters of pro-eutectic Si crystals of these samples, tensile strengths and wear amounts which were measured in the like manner as the foregoing Example, are shown in the following Table 2.

If the maximum particle diameter of pro-eutectic Si crystal is small, the strength is high, however, it was understood that, when the maximum particle diameter is smaller than 5 μm or larger than 60 μm, the wear resistance is lowered.

TABLE 2

| Sample No. | Item: Maximum Particle Diameter of Pro-Eutectic Si (μm) | Tensile Strength (MPa) | Wear Amount (mm) |
|---|---|---|---|
| 19 | 2 | 440 | Seizing |
| 20 | 5 | 410 | 0.3 |
| 21 | 25 | 380 | 0.01 |
| 22 | 50 | 370 | 0.02 |
| 23 | 65 | 365 | 1.0 |

EXAMPLE 3

Powder materials shown in Table 3 were mixed together in the weight ratios also shown in table 3 and green compact samples were prepared. They were dewaxed at 400° C. and sintered at 540° C. for 60 minutes. The samples were subjected to hot press forging in the like manner as the foregoing examples, and some samples were further subjected to solution heat treatment at 490° C. and aging treatment at 240° C. The tensile strengths and elongations were measured, the results of which are shown in the following Table 4 (Sample Nos. 24–28). In the observation of cross-sectional grain structures, when the intermetallic compound mainly containing Cu was observed, a symbol a was attached to the number of sample, while if it was not observed, the sample was represented with a symbol b.

It was understood that the elongation was much improved in the samples in which the intermetallic compound was extinguished by solution heat treatment and aging treatment (sample Nos. 24b–27b).

TABLE 3

Unit: % by weight

| Powder Materials | Sample No. 24 | 25 | 26 | 27 | 28 |
|---|---|---|---|---|---|
| Al—20%Si Powder | 35.0 | 60.0 | 75.0 | — | — |
| Al—25%Si Powder | — | — | — | 60.0 | — |
| Pure Al Powder | 59.8 | 34.8 | 19.8 | 34.8 | — |
| Cu—4%Ni Powder | 4.2 | 4.2 | 4.2 | 4.2 | — |
| Al—50%Mg Powder | 1.0 | 1.0 | 1.0 | 1.0 | — |
| Rapidly Solidified Alloy Powder(*) | — | — | — | — | 100 |

(*)Al—15%Si—4%Cu—0.5%Mg—0.17%Ni

TABLE 4

| Sample No. | Item: Existence of Intermetallic Compounds | Tensile Strength (MPa) | Elongation (%) |
|---|---|---|---|
| 24a | Yes | 400 | 4.0 |
| 25a | Yes | 410 | 1.5 |
| 26a | Yes | 380 | 1.0 |
| 27a | Yes | 380 | 1.0 |
| 24b | No | 400 | 8.5 |
| 25b | No | 410 | 3.0 |
| 26b | No | 380 | 2.5 |
| 27b | No | 380 | 2.5 |

EXAMPLE 4

Powder materials shown in Table 5 were mixed together in the weight ratios also shown in table 5 and green compact samples were prepared. They were dewaxed at 400° C. and sintered at 540° C. for 60 minutes. The samples were subjected to hot press forging and further subjected to solution heat treatment at 490° C. and aging treatment at 240° C. The tensile strengths and elongations were measured and results of them are shown in the following Table 6.

In the samples containing transition metals such as Ni, Ti, V, Cr, Mn, Fe, Co, and Zr, the intermetallic compound mainly containing Cu was extinguished in the cross-sectional grain structure and exhibiting elongation values similar to the foregoing examples. However, when elements other than the transition metals were added, the intermetallic compound mainly containing Cu was observed and the values of elongation were low.

TABLE 5

Unit: % by weight

| Powder Materials | Sample No. | | | |
|---|---|---|---|---|
| | 29 | 30 | 31 | 32 |
| Al—20%Si Powder | 60.0 | 60.0 | 60.0 | 60.0 |
| Pure Al Powder | 36.0 | 35.94 | 35.67 | 35.67 |
| Pure Cu Powder | 3.0 | — | — | — |
| Cu—8%P Powder | — | 3.06 | — | — |
| Cu—10%Sn Powder | — | — | 3.33 | — |
| Cu—10%Zn Powder | — | — | — | 3.33 |
| Al—50%Mg Powder | 1.0 | 1.0 | 1.0 | 1.0 |
| | 33 | 34 | 35 | 36 |
| Al—20%Si Powder | 60.0 | 60.0 | 60.0 | 60.0 |
| Pure Al Powder | 35.87 | 35.87 | 35.99 | 35.98 |
| Cu—4%Ni Powder | 3.13 | — | — | — |
| Cu—4%Ti Powder | — | 3.13 | — | — |
| Cu—0.3%V Powder | — | — | 3.01 | — |
| Cu—0.6%Cr Powder | — | — | — | 3.02 |
| Al—50%Mg Powder | 1.0 | 1.0 | 1.0 | 1.0 |
| | 37 | 38 | 39 | 40 |
| Al—20%Si Powder | 60.0 | 60.0 | 60.0 | 60.0 |
| Pure Al Powder | 35.87 | 35.94 | 35.91 | 35.7 |
| Cu—4%Mn Powder | 3.13 | — | — | — |
| Cu—2%Fe Powder | — | 3.06 | — | — |
| Cu—3%Co Powder | — | — | 3.09 | — |
| Cu—9%Zr Powder | — | — | — | 3.3 |
| Al—50%Mg Powder | 1.0 | 1.0 | 1.0 | 1.0 |

TABLE 6

| Sample No. | Item | | |
|---|---|---|---|
| | Existence of Intermetallic Compounds | Tensile Strength (MPa) | Elongation (%) |
| 29 | Yes | 410 | 1.5 |
| 30 | Yes | 410 | 1.5 |
| 31 | Yes | 400 | 1.5 |
| 32 | Yes | 400 | 1.5 |
| 33 | No | 410 | 3.5 |
| 34 | No | 410 | 3.5 |
| 35 | No | 410 | 3.5 |
| 36 | No | 410 | 3.5 |
| 37 | No | 410 | 3.5 |
| 38 | No | 410 | 3.5 |
| 39 | No | 410 | 3.5 |
| 40 | No | 400 | 3.0 |

EXAMPLE 5

The powder materials used were 5 kinds of Al-Si alloy powders containing 15%, 17%, 20%, 25% and 30% of Si, pure Al powder, Cu-4% Ni alloy powder, and Al-50% Mg alloy powder. These powders were mixed in the ratios shown in Tables 7-1 to 7-3 and formed into green compacts in a predetermined shape. The green compacts were dewaxed at 400° C. and sintered at 540° C. for 10 minutes. After that, the density ratios of them were made to 100% by hot press forging, and they were subjected to solution heat treatment at 490° C. and aging treatment at 240° C. The cross-sectional area ratios of Al-Si alloy phase and Al solid solution phase of each sample were the same as the compounding ratios of Al-Si alloy powder and pure Al powder, respectively. The maximum diameter of the pro-eutectic Si crystals in the Al-Si alloy phase was 3–4 μm.

These samples were heated by a high frequency induction furnace to obtain sample Nos. 41 to 59.

In connection with each of the obtained samples, the composition, area ratios in the cross-section of dapple grain structure of Al-Si alloy phase and Al solid solution phase, the maximum diameter of pro-eutectic Si crystals in the surface portion which were grown by the high frequency heating, the thickness of the layer from the surface which contained the grown particles of pro-eutectic Si, and the maximum diameter of pro-eutectic Si crystals in the inner part of sample, were measured and results are shown in the following Tables 7-1 to 7-3.

Furthermore, the wear amount of each sample was measured by pin-on-disk wear test. The results of them are also shown in the following Table Nos. 7-1 to 7-3. The test with the pin-on-disk wear test were done in the like manner as in Example 1.

According to the results shown in Table Nos. 7-1 to 7-3, the maximum diameters of pro-eutectic Si crystals in the surface portion were 24–26 μm. In the sample Nos. 41, 43, 50, 53, 55, 58 and 59 in which the area ratios of Al-Si alloy phase and Al solid solution phase do not meet the condition of 8:2 to 2:8, the wear amounts were large or seizure was caused to occur. In the other samples, the area ratios of Al-Si alloy phase and Al solid solution phase in dapple grain structures were within the predetermined range and in those cases, the wear amounts were small.

TABLE 7-1

| | Sample No. | | | | | | |
|---|---|---|---|---|---|---|---|
| | 41 | 42 | 43 | 44 | 45 | 46 | 47 |
| Composition of Elements (wt. %) | | | | | | | |
| Al | 92.5 | 90.6 | 90.5 | 90.3 | 90.3 | 85.3 | 85.3 |
| Si | 2.8 | 4.7 | 4.8 | 5.0 | 5.0 | 10.0 | 10.0 |
| Cu | 4.0 | 4.0 | 4.0 | 4.0 | 4.0 | 4.0 | 4.0 |
| Ni | 0.2 | 0.2 | 0.2 | 0.2 | 0.2 | 0.2 | 0.2 |
| Mg | 0.5 | 0.5 | 0.5 | 0.5 | 0.5 | 0.5 | 0.5 |
| Composition of Powders (wt. %) | | | | | | | |
| Al—Si Alloy Powder | | | | | | | |
| 15Si | — | — | — | — | — | — | — |
| 17Si | — | — | — | — | 29.40 | — | 58.79 |
| 20Si | — | — | — | 24.94 | — | — | — |
| 25Si | — | 18.97 | — | — | — | — | — |
| 30Si | 9.48 | — | 16.12 | — | — | 33.29 | — |
| Pure Al Powder | 85.35 | 75.86 | 78.71 | 69.89 | 65.43 | 61.54 | 36.04 |
| Cu—4Ni Alloy Powder | 4.17 | 4.17 | 4.17 | 4.17 | 4.17 | 4.17 | 4.17 |
| Al—50Mg Alloy Powder | 1.00 | 1.00 | 1.00 | 1.00 | 1.00 | 1.00 | 1.00 |

TABLE 7-1-continued

| | Sample No. | | | | | | |
|---|---|---|---|---|---|---|---|
| | 41 | 42 | 43 | 44 | 45 | 46 | 47 |
| Area Ratio in Cross-Section of Phases (%) | | | | | | | |
| Al—Si Alloy Phase | 10.0 | 20.0 | 17.0 | 26.3 | 31.0 | 35.1 | 62.0 |
| Al Solid Soln. Phase | 90.0 | 80.0 | 83.0 | 73.7 | 69.0 | 64.9 | 38.0 |
| Pro-Eutectic Si near Surface | | | | | | | |
| Max. Dia. (μm) | 25 | 24 | 25 | 26 | 25 | 26 | 25 |
| Thickness (mm) | 0.50 | 0.51 | 0.50 | 0.51 | 0.51 | 0.50 | 0.50 |
| Pro-Eutectic Si in Inner Part | | | | | | | |
| Max. Dia. (μm) | 3 | 3 | 3 | 3 | 4 | 3 | 4 |
| Wear Amount (mm) | Seizure | 0.20 | 0.34 | 0.10 | 0.05 | 0.04 | 0.02 |

TABLE 7-2

| | Sample No. | | | | | | |
|---|---|---|---|---|---|---|---|
| | 48 | 49 | 50 | 51 | 52 | 53 | 54 |
| Composition of Elements (wt. %) | | | | | | | |
| Al | 85.3 | 85.3 | 81.1 | 81.1 | 80.3 | 80.3 | 80.3 |
| Si | 10.0 | 10.0 | 14.2 | 14.2 | 15.0 | 15.0 | 15.0 |
| Cu | 4.0 | 4.0 | 4.0 | 4.0 | 4.0 | 4.0 | 4.0 |
| Ni | 0.2 | 0.2 | 0.2 | 0.2 | 0.2 | 0.2 | 0.2 |
| Mg | 0.5 | 0.5 | 0.5 | 0.5 | 0.5 | 0.5 | 0.5 |
| Composition of Powders (wt. %) | | | | | | | |
| Al—Si Alloy Powder | | | | | | | |
| 15Si | — | — | 94.83 | — | — | — | — |
| 17Si | — | — | — | — | — | 88.19 | — |
| 20Si | 49.98 | — | — | 71.12 | — | — | — |
| 25Si | — | 40.02 | — | — | — | — | 60.03 |
| 30Si | — | — | — | — | 49.98 | — | — |
| Pure Al Powder | 44.85 | 54.81 | 0.00 | 23.71 | 44.85 | 6.64 | 34.80 |
| Cu—4Ni Alloy Powder | 4.17 | 4.17 | 4.17 | 4.17 | 4.17 | 4.17 | 4.17 |
| Al—50Mg Alloy Powder | 1.00 | 1.00 | 1.00 | 1.00 | 1.00 | 1.00 | 1.00 |
| Area Ratio in Cross-Section of Phases (%) | | | | | | | |
| Al—Si Alloy Phase | 52.7 | 42.2 | 100.0 | 75.0 | 52.7 | 93.0 | 63.3 |
| Al Solid Soln. Phase | 47.3 | 57.8 | 0.0 | 25.0 | 47.3 | 7.0 | 36.7 |
| Pro-Eutectic Si near Surface | | | | | | | |
| Max. Dia. (μm) | 25 | 25 | 25 | 25 | 24 | 25 | 26 |
| Thickness (mm) | 0.50 | 0.50 | 0.49 | 0.49 | 0.50 | 0.50 | 0.51 |
| Pro-Eutectic Si in Inner Part | | | | | | | |
| Max. Dia. (μm) | 4 | 3 | 3 | 3 | 4 | 3 | 3 |
| Wear Amount (mm) | 0.02 | 0.03 | Seizure | 0.02 | 0.03 | 1.00 | 0.03 |

TABLE 7-3

| | Sample No. | | | | |
|---|---|---|---|---|---|
| | 55 | 56 | 57 | 58 | 59 |
| Composition of Elements (wt. %) | | | | | |
| Al | 76.3 | 75.4 | 75.4 | 71.6 | 70.3 |
| Si | 19.0 | 19.9 | 19.9 | 23.7 | 25.0 |
| Cu | 4.0 | 4.0 | 4.0 | 4.0 | 4.0 |
| Ni | 0.2 | 0.2 | 0.2 | 0.2 | 0.2 |
| Mg | 0.5 | 0.5 | 0.5 | 0.5 | 0.5 |
| Composition of Powders (wt. %) | | | | | |
| Al—Si Alloy Powder | | | | | |
| 15Si | — | — | — | — | — |
| 17Si | — | — | — | — | — |
| 20Si | 94.83 | — | — | — | — |
| 25Si | — | 79.66 | — | 94.83 | — |
| 30Si | — | — | 66.38 | — | 83.45 |
| Pure Al Powder | 0.00 | 15.17 | 28.45 | 0.00 | 11.38 |
| Cu—4Ni Alloy Powder | 4.17 | 4.17 | 4.17 | 4.17 | 4.17 |
| Al—50Mg Alloy Powder | 1.00 | 1.00 | 1.00 | 1.00 | 1.00 |
| Area Ratio in Cross-Section of Phases (%) | | | | | |
| Al—Si Alloy Phase | 100.0 | 84.0 | 70.0 | 100.0 | 88.0 |
| Al Solid Soln. Phase | 0.0 | 16.0 | 30.0 | 0.0 | 12.0 |
| Pro-Eutectic Si near Surface | | | | | |
| Max. Dia. (μm) | 25 | 24 | 25 | 25 | 25 |
| Thickness (mm) | 0.50 | 0.50 | 0.49 | 0.50 | 0.49 |
| Pro-Eutectic Si in Inner Part | | | | | |
| Max. Dia. (μm) | 3 | 4 | 4 | 3 | 3 |
| Wear Amount (mm) | Seizure | 0.20 | 0.03 | Seizure | 0.40 |

EXAMPLE 6

The powder materials of Al-20 Si alloy powder, pure Al powder, Cu-4% Ni alloy powder, and Al-50% Mg powder were mixed in the ratios shown in Tables 8-1 and 8-2 and, in the like manner as in Example 5, the powder mixtures were subjected to compacting, sintering, hot press forging, solution heat treatment and aging treatment. Resultant samples were further treated by high frequency heating to obtain Sample Nos. 60–68.

In addition, Sample Nos. 69–72 were prepared in the like manner as the above, however, they were treated by aging but were not subjected to high frequency heating.

In connection with each of the above obtained Sample Nos. 60–72, the composition, area ratios in the cross-section of grain structure of Al-Si alloy phase and Al solid solution phase, the maximum diameter of pro-eutectic Si crystals in the surface portion which were grown by high frequency heating, the thickness of the layer from the surface which contained the grown crystals of pro-eutectic Si, and the maximum diameter of the pro-eutectic Si crystals in the inner part of the sample, were measured and the results are shown in the following Tables 8-1 and 8-2.

Furthermore, the tensile strength and wear amount by pin-on-disk wear test of each sample were measured. The results of them are also shown in the following Table Nos. 8-1 and 8-2.

According to the results shown in the tables, the maximum diameters of pro-eutectic Si crystals in sliding portion was smaller than 5 μm in Sample No. 69 and that of Sample No. 68 was larger than 60 μm. In these samples, the wear amount was quite large or seizure was caused to occur. In Sample No. 61, the maximum diameters of pro-eutectic Si crystals in sliding portion was within the range of 5 to 60 μm but its thickness was smaller than 0.05 mm, so that the seizure was caused to occur.

There is a tendency that the larger the maximum diameters of pro-eutectic Si crystals in the surface portion, the lower the tensile strength. However, when the maximum diameters of pro-eutectic Si crystals in the inner part were small, higher tensile strength can be obtained as compared with Sample Nos. 70–72 which contain larger pro-eutectic Si crystals in the inner part. It was also understood that, when the thickness of the surface layer containing grown of pro-eutectic Si crystals was small, the tensile strength was high.

TABLE 8-1

| | Sample No. | | | | | | |
|---|---|---|---|---|---|---|---|
| | 60 | 61 | 62 | 63 | 64 | 65 | 66 |
| Composition of Elements (wt. %) | | | | | | | |
| Al | 81.1 | 81.1 | 81.1 | 81.1 | 81.1 | 81.1 | 81.1 |
| Si | 14.2 | 14.2 | 14.2 | 14.2 | 14.2 | 14.2 | 14.2 |
| Cu | 4.0 | 4.0 | 4.0 | 4.0 | 4.0 | 4.0 | 4.0 |
| Ni | 0.2 | 0.2 | 0.2 | 0.2 | 0.2 | 0.2 | 0.2 |
| Mg | 0.5 | 0.5 | 0.5 | 0.5 | 0.5 | 0.5 | 0.5 |
| Composition of Powders (wt. %) | | | | | | | |
| Al—20Si Alloy Powder | 71.12 | 71.12 | 71.12 | 71.12 | 71.12 | 71.12 | 71.12 |
| Pure Al Powder | 23.71 | 23.71 | 23.71 | 23.71 | 23.71 | 23.71 | 23.71 |
| Cu—4Ni Alloy Powder | 4.17 | 4.17 | 4.17 | 4.17 | 4.17 | 4.17 | 4.17 |
| Al—50Mg Alloy Powder | 1.00 | 1.00 | 1.00 | 1.00 | 1.00 | 1.00 | 1.00 |
| Area Ratio in Cross-Section of Phases (%) | | | | | | | |
| Al—Si Alloy Phase | 75.0 | 75.0 | 75.0 | 75.0 | 75.0 | 75.0 | 75.0 |
| Al Solid Soln. Phase | 25.0 | 25.0 | 25.0 | 25.0 | 25.0 | 25.0 | 25.0 |
| Pro-Eutectic Si near Surface | | | | | | | |
| Max. Dia. (μm) | 5 | 25 | 25 | 24 | 25 | 25 | 25 |
| Thickness (mm) | 0.49 | 0.02 | 0.50 | 0.10 | 0.50 | 1.00 | 1.50 |
| Pro-Eutectic Si in Inner Part | | | | | | | |
| Max. Dia. (μm) | 3 | 4 | 4 | 4 | 3 | 3 | 3 |
| Wear Amount (mm) | 0.30 | Seizure | 0.02 | 0.03 | 0.02 | 0.02 | 0.02 |
| Tensile Strength (MPa) | 422 | 420 | 418 | 416 | 412 | 398 | 388 |

TABLE 8-2

| | Sample No. | | | | | |
|---|---|---|---|---|---|---|
| | 67 | 68 | 69 | 70 | 71 | 72 |
| Composition of Elements (wt. %) | | | | | | |
| Al | 81.1 | 81.1 | 81.1 | 81.1 | 81.1 | 81.1 |
| Si | 14.2 | 14.2 | 14.2 | 14.2 | 14.2 | 14.2 |
| Cu | 4.0 | 4.0 | 4.0 | 4.0 | 4.0 | 4.0 |
| Ni | 0.2 | 0.2 | 0.2 | 0.2 | 0.2 | 0.2 |
| Mg | 0.5 | 0.5 | 0.5 | 0.5 | 0.5 | 0.5 |
| Composition of Powders (wt. %) | | | | | | |
| Al—20Si Alloy Powder | 71.12 | 71.12 | 71.12 | 71.12 | 71.12 | 71.12 |
| Pure Al Powder | 23.71 | 23.71 | 23.71 | 23.71 | 23.71 | 23.71 |
| Cu—4Ni Alloy Powder | 4.17 | 4.17 | 4.17 | 4.17 | 4.17 | 4.17 |
| Al—50Mg Alloy Powder | 1.00 | 1.00 | 1.00 | 1.00 | 1.00 | 1.00 |
| Area Ratio in Cross-Section of Phases (%) | | | | | | |
| Al—Si Alloy Phase | 75.0 | 75.0 | 75.0 | 75.0 | 75.0 | 75.0 |
| Al Solid Soln. Phase | 25.0 | 25.0 | 25.0 | 25.0 | 25.0 | 25.0 |
| Pro-Eutectic Si near Surface | | | | | | |
| Max. Dia. (μm) | 50 | 65 | 3 | 25 | 50 | 65 |
| Thickness (mm) | 0.50 | 0.50 | — | — | — | — |
| Pro-Eutectic Si in Inner Part | | | | | | |
| Max. Dia. (μm) | 4 | 3 | 3 | 25 | 50 | 65 |
| Wear Amount (mm) | 0.02 | 1.00 | Seizure | 0.02 | 0.02 | 1.00 |
| Tensile Strength (MPa) | 408 | 406 | 430 | 380 | 370 | 365 |

As described above, the Al-Si sintered alloy according to the present invention has a dapple grain structure of an Al-solid solution phase and an Al-Si alloy phase containing dispersed pro-eutectic Si crystals having a maximum diameter of 5–60 μm. The cross-sectional area of the Al-solid solution phase in the grain structure is in the range of 20–80%.

Furthermore, in a preferable embodiment, the proeutectic Si crystals having a maximum diameter of 5–60 μm is distributed only in the surface portion of the sintered alloy body and the thickness of the surface portion is 0.05 to 1 mm. Meanwhile, pro-eutectic Si crystals in other parts are less than 5 μm in diameter.

The sintered alloy in accordance with the present invention has excellent mechanical strength and elongation and is especially good in wear resistance. Accordingly, it is expected to utilize the sintered alloy to the production of light-weight parts such as various kinds of gearwheels, pulleys, compressor vanes, connecting rods and pistons. Furthermore, the alloy of the invention can contribute to the expansion of the utility of parts made of the sintered alloy.

What is claimed is:

1. A wear-resistant sintered aluminum alloy which consists of, in terms of weight, 2.4–23.5% Si, 2–5% Cu, 0.2–1.5% Mg, 0.01–1% of one or more members selected from the group of transition metals consisting of Ti, V, Cr, Mn, Fe, Co, Ni, Zr and Nb, and the balance of aluminum and unavoidable impurities; which has a dapple grain structure of an Al solid solution phase having Si, Cu, Mg and said transition metal diffused therein and an Al-Si alloy phase containing dispersed pro-eutectic Si crystals having a maximum diameter of 5–60 μm, and the area of said Al solid solution phase is 21 to 80 percent in the cross-section of said dapple grain structure.

2. The wear-resistant sintered aluminum alloy as claimed in claim 1, wherein said pro-eutectic Si crystals having a maximum diameter of 5–60 μm are uniformly dispersed in the grains of said Al-Si alloy phase in the whole body of sintered alloy.

3. The wear-resistant sintered aluminum alloy as claimed in claim 1, wherein said pro-eutectic Si crystals having a maximum diameter of 5–60 μm are dispersed in the grains of said Al-Si alloy phase existing in the vicinity of the external surface or at least in a contact surface of said sintered alloy and other pro-eutectic Si crystals having a diameter of less than 5 μm are dispersed in the grains of said Al-Si alloy phase existing in the other part of the body of said sintered alloy.

4. The wear-resistant sintered aluminum alloy as claimed in claim 3, wherein the thickness of the portion of Al-Si alloy phase containing dispersed pro-eutectic Si crystals having a maximum diameter of 5–60 μm, is 0.05–1 mm as measured from the surface of said sintered alloy.

5. A method for producing a wear-resistant sintered aluminum alloy which comprises the steps of:

preparing a mixture of 20–80 parts by weight of Al-Si alloy powder containing 13 to 30 wt. % of Si and 80-20 parts by weight of Al powder;

adding a Cu-transition metal alloy powder containing 0.2–30 wt. % of one or more members selected from the group of transition metals consisting of Ti, V, Cr, Mn, Fe, Co, Ni, Zr, and Nb; and Mg powder or an Al-Mg alloy powder containing 35 wt. % or more of Mg, to said mixture of Al powder and Al-Si alloy powder, thereby obtaining a powder mixture having the composition consisting of, in terms of weight, 2.4–23.5% Si, 2–5% Cu, 0.2–1.5% Mg, 0.01–1% of said transition metals and the balance of aluminum and unavoidable impurities;

compacting the thus obtained powder mixture into a green compact; and sintering said green compact to obtain a sintered aluminum alloy which consists of, in terms of weight, 2.4–23.5% Si, 2–5% Cu, 0.2–1.5% Mg, 0.01–1% of said transition metals and the balance of aluminum and unavoidable impurities; and which has a dapple grain structure of an Al solid solution phase having Si, Cu, Mg and said transition metal diffused therein and an Al-Si alloy phase containing dispersed pro-eutectic Si crystals having a maximum diameter of 5–60 μm, and the area of said Al solid solution phase is 21 to 80 percent in the cross-section of said dapple grain structure.

6. The method for producing a wear-resistant sintered aluminum alloy as claimed in claim 5, wherein said pro-eutectic Si crystals contained in said Al-Si alloy phase in said sintered aluminum alloy are grown up to 5–60 μm in the maximum diameter by heating the whole body of said sintered aluminum alloy, which is followed by cooling.

7. The method for producing a wear-resistant sintered aluminum alloy as claimed in claim 5, wherein said pro-eutectic Si crystals in said Al-Si alloy contained in the vicinity of the surface of said sintered aluminum alloy are grown up to 5–60 μm in the maximum diameter by heating the external surface of said sintered aluminum alloy, which is followed by cooling.

8. The method for producing a wear-resistant sintered aluminum alloy as claimed in claim 7, wherein said heating of the surface of said sintered aluminum alloy is carried out by high-frequency heating, plasma heating or laser beam heating.

* * * * *